United States Patent [19]

Borowick

[11] 4,114,163

[45] Sep. 12, 1978

[54] L-BAND RADAR ANTENNA ARRAY

[75] Inventor: John Joseph Borowick, Bricktown, N.J.

[73] Assignee: The United States of America as represented by the Secretary of the Army, Washington, D.C.

[21] Appl. No.: 747,765

[22] Filed: Dec. 6, 1976

[51] Int. Cl.[2] ..... H01Q 21/12; H01Q 9/28; H01Q 19/10

[52] U.S. Cl. ..... 343/815; 343/795; 343/818; 343/834

[58] Field of Search ..... 343/795, 815, 816, 817, 343/818, 834, 895

[56] References Cited

U.S. PATENT DOCUMENTS

| | | | |
|---|---|---|---|
| 2,270,314 | 1/1942 | Kraus | 343/834 |
| 2,745,102 | 5/1956 | Norgorden | 343/834 |
| 2,893,004 | 6/1959 | Kobler | 343/818 |
| 2,962,716 | 11/1960 | Engelmann | 343/815 |
| 2,969,542 | 1/1961 | Coleman et al. | 343/895 |
| 3,836,976 | 9/1974 | Monser | 343/795 |
| 4,001,834 | 1/1977 | Smith | 343/795 |

*Primary Examiner*—Alfred E. Smith
*Assistant Examiner*—Harry E. Barlow
*Attorney, Agent, or Firm*—Nathan Edelberg; Sheldon Kanars; Edward Goldberg

[57] ABSTRACT

A stripline horizontally polarized dipole and passive director antenna array, operative at L-band (1220-1280MHz), mounted in a 90° corner reflector constructed of a grid of cylindrical rods which are hinged along its apex permitting folding of the reflector over the antenna array to protect the elements of the array, for example, during transport.

9 Claims, 5 Drawing Figures

FIG. 1
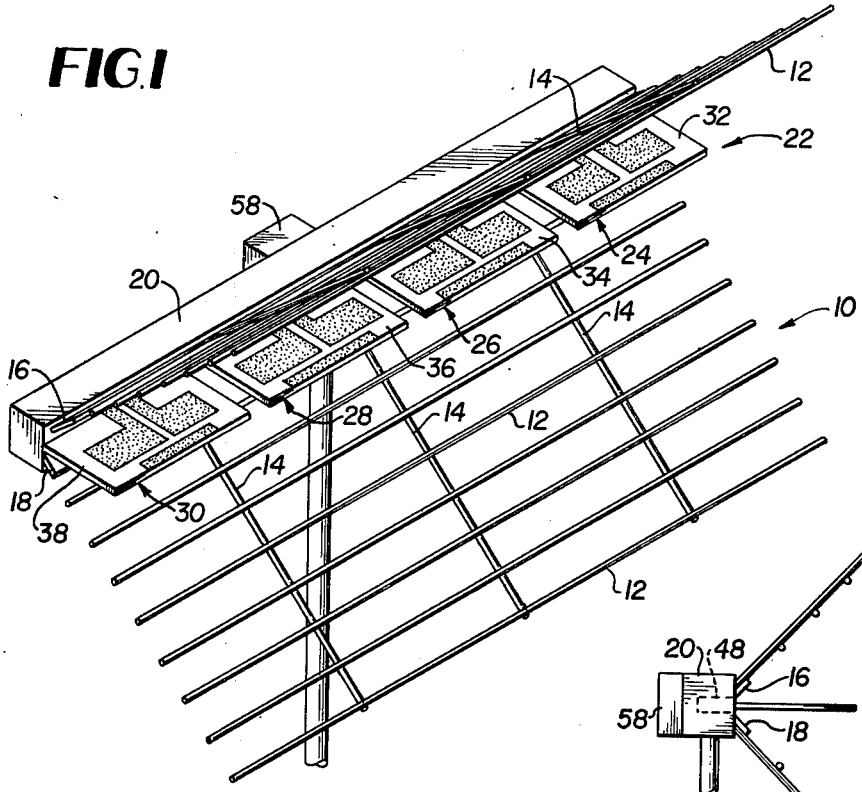
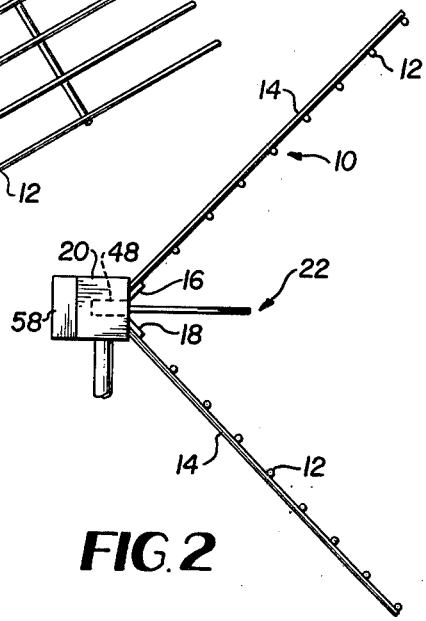
FIG. 2
FIG. 3
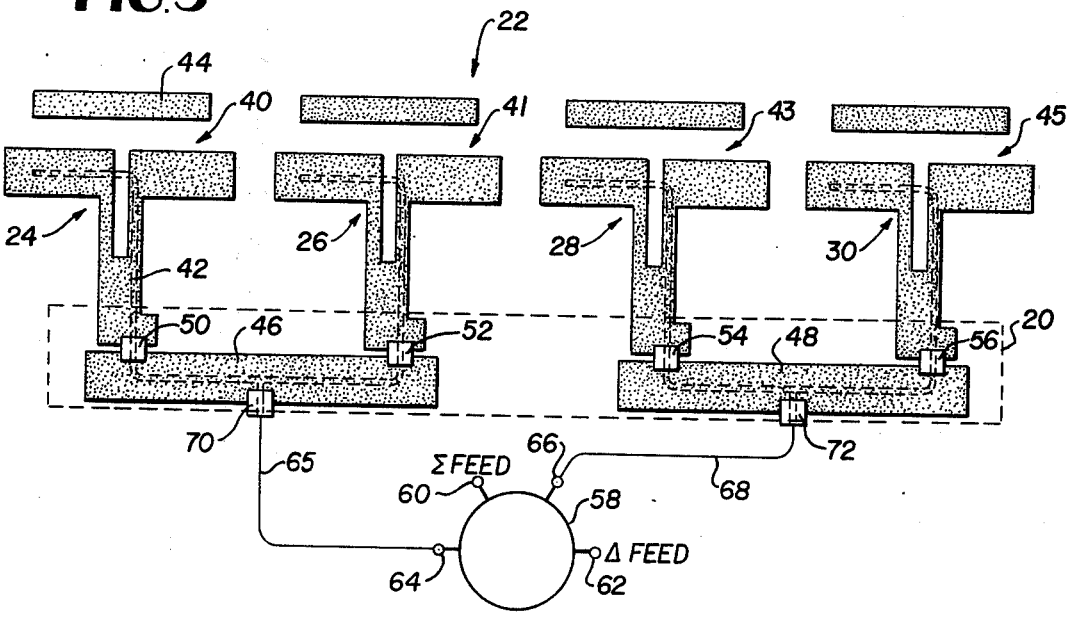

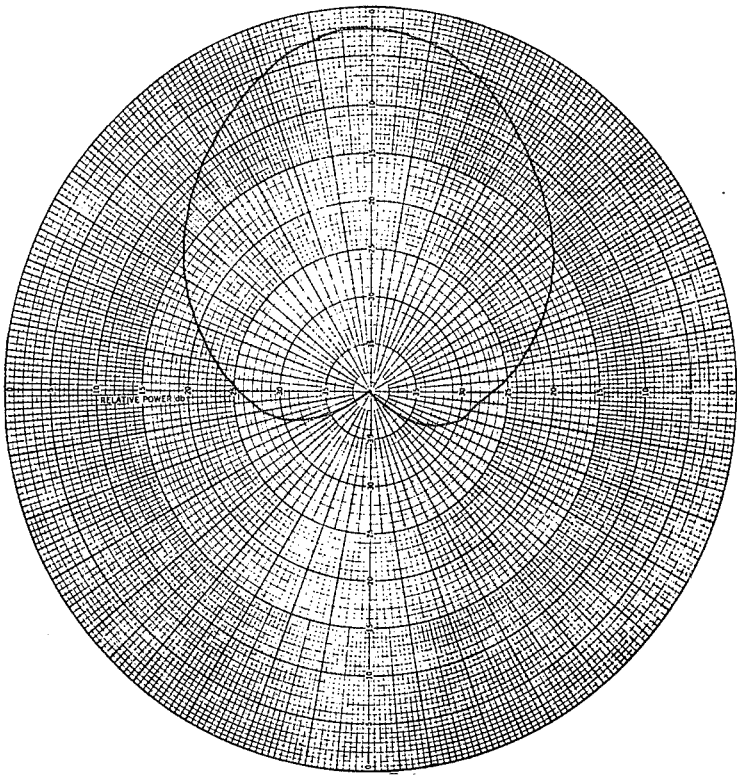
FIG. 5 Measured radiation pattern, L-band corner reflector antenna
1250 MHz, Elevation (H) plane
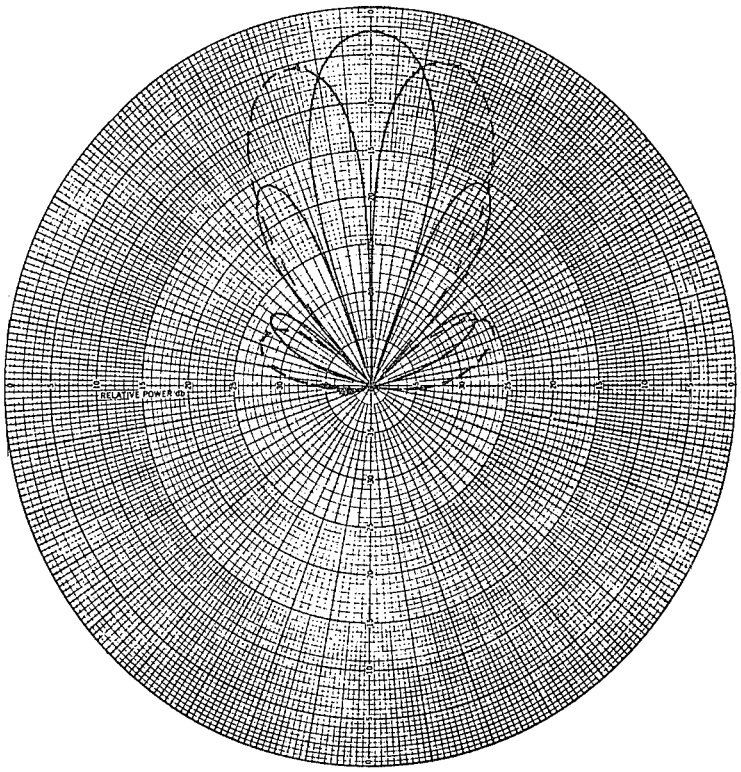
FIG. 4 Measured radiation pattern, L-band corner reflector antenna
——— sum feed
------ difference feed
1250 MHz, Azimuth (E) plane

L-BAND RADAR ANTENNA ARRAY

The invention described herein may be manufactured and used by or for the Government for governmental purposes without the payment of any royalties thereon or therefor.

CROSS REFERENCE TO RELATED APPLICATION

The present invention is related to U.S. Ser. No. 747,764, entitled "Antenna For Combined Surveillance and Foliage Penetration Radar", the inventor being John Borowick, the present applicant, which application is also assigned to the assignee of the subject invention.

BACKGROUND OF THE INVENTION

This invention relates generally to short range microwave radars and more particularly to a radar adapted to penetrate foliage.

The corresponding related application is directed to a combined surveillance and foliage penetration radar wherein an X-band surveillance radar antenna comprised of a flat plate array of broadwall waveguide slots is used as a reflector for an L-band foliage penetration radar array comprising stripline dipole elements mounted in front of the flat plate array. Whereas the cross referenced application is directed to a dual frequency aperture sharing radar antenna, the subject invention is directed to single band (L-band) operation which is particularly adapted for foliage penetration applications.

SUMMARY

Briefly, the subject invention is directed to a radar antenna comprised of a stripline dipole and passive director array mounted at the apex of a 90° corner reflector. The stripline array is energized by monopulse radar apparatus operative at L-band. The corner reflector is comprised of a plurality of cylindrical rods arranged in mutually parallel relationship in line with the dipole and director elements of the stripline array. Furthermore, the reflector is hinged along its apex, permitting folding of the reflector over the stripline array to protect the stripline elements.

BRIEF DESCRIPTION OF THE DRAWINGS

FIG. 1 is a perspective view illustrative of the preferred embodiment of the subject invention;

FIG. 2 is a side planar view of the embodiment shown in FIG. 1;

FIG. 3 is an electrical schematic diagram illustrative of the microwave feed circuit for the antenna elements shown in FIG. 1;

FIG. 4 is a polar graph illustrative of the measured radiation pattern of the subject invention in the azimuth plane; and FIG. 5 is a polar graph illustrative of the measured radiation pattern of the subject invention in the elevation plane.

DESCRIPTION OF THE PREFERRED EMBODIMENT

Referring now to the figures, and more particularly to FIGS. 1 and 2, reference numeral 10 generally designates a 90° corner reflector for microwave radar signals, and more particularly for radar apparatus operating in the L-band (1220–1280MHz) of the electromagnetic spectrum. These frequencies are capable of penetrating foliage which is of particular importance in certain military applications. The corner reflector 10 is comprised of a grid of cylindrical rods comprised of aluminum or the like in order to provide a structure which is not only light in weight, but provides minimum resistance to wind when in use. The reflector grid, moveover, is comprised of a plurality of longitudinal rods 12 of substantially equal cross section and length mounted on a plurality of aluminum transverse support members 14 which are attached to a pair of longitudinally extending hinge members 16 and 18, which in turn are mounted on a housing 20 so that the grid members making up the reflector 10 can be folded together when desirable, such as during transport.

Projecting outwardly from the housing 20 at the apex of the corner reflector 10 is an in-line array 22 of four identical L-band stripline antenna sections 24, 26, 28 and 30. The antenna elements included thereon are fabricated on separate dielectric cards or sheets 32, 34, 36 and 38, respectively. When desirable, however, the four antenna sections could be fabricated on a single dielectric sheet.

Taking one antenna section 24, for example, it is comprised of a stripline dipole antenna element 40, having an inner conductor 42 located behind a passive stripline director element 44, as illustrated in FIG. 3. Referring further to FIG. 3, the dipole elements 40 and 41, for example, are fed in pairs, being coupled to a stripline power splitter 46 located in the housing 20. In a like manner, the dipole elements 43 and 45 are coupled to a stripline power splitter 48, also located in the housing 20. Coupling is achieved for example, by respective back-to-back coaxial to stripline RF connectors 50, 52, 54 and 56.

Coupling of the stripline dipole/director array 22 to an L-band monopulse radar set, not shown, is achieved by means of a stripline hybrid ring 58 which includes a first pair of microwave ports 60 and 62 which are adapted to be connected to the sum ($\epsilon$) and difference ($\Delta$) feeds of the radar. A second pair of microwave ports 64 and 66 are respectively connected to the stripline power splitters 46 and 48 by means of transmission lines 65 and 68, which may be, for example, coaxial transmission lines coupled to coaxial to stripline connectors 70 and 72.

The radar antenna array thus constructed is adapted to be mechanically scanned in azimuth and provides horizontally polarized radiation for monopulse operation. A typical measured radiation pattern in the azimuth plane for the sum and difference feeds, moreover, is shown in FIG. 4, while a typical radiation pattern in the elevation plane is shown in FIG. 5. Both patterns were obtained at a mid-range operating frequency of, for example, 1250MHz. This frequency range results in lesser attenuation through foliage and therefore is adapted to penetrate an area which would otherwise be undetectable with an X-band array. The antenna as shown in FIG. 1 has experimentally been shown to have enhanced gain while providing minimum resistance to wind and still light enough so that it can be hoisted atop a light weight man portable mast.

Having thus described what is at present considered to be the preferred embodiment of the subject invention,

I claim:

1. A radar antenna for monopulse radar apparatus particularly adapted for a foliage penetration mode of operation, comprising in combination:

a hinged foldable corner reflector including a grid of parallel rod type elements and a housing at the apex of said reflector, said grid including a plurality of transverse support members and longitudinal members secured to said support members, a plurality of longitudinal hinge members mounted along said housing and spaced about said apex, said transverse support members being secured to said hinge members;

flat dielectric support means positioned in line with said apex and extending from said housing;

an array of stripline dipole elements located on said support means along a common plane at said apex of said corner reflector, said reflector being foldable about opposite sides of said support means and dipole elements and extending parallel to said common plane in a folded position; and means within said housing electrically coupling said array of dipole elements to said monopulse radar apparatus.

2. The system as defined by claim 1 wherein said stripline array includes a plurality of dipole elements having respective plural passive director elements selectively located on said support means adjacent respective said plurality of dipole elements.

3. The antenna as defined by claim 2 wherein said plurality of dipole elements are operated in pairs, and additionally including respective stripline power splitter means coupled to said pairs.

4. The antenna as defined by claim 3 and additionally including microwave power distribution means coupled between said respective stripline power splitter means and said monopulse radar system.

5. The antenna as defined by claim 2 wherein said plurality of dipole elements and respective director elements are fabricated on individual dielectric sheets.

6. The antenna as defined by claim 5 wherein said individual dielectric sheets are arranged in an in-line configuration in said common plane generally bisecting the angle of the corner reflector.

7. The antenna system as defined by claim 1 wherein said corner reflector comprises a 90° corner reflector.

8. The antenna as defined by claim 7 wherein said grid of antenna elements consists of two sets of mutually parallel rod type elements.

9. The antenna system as defined by claim 8 wherein said two sets of parallel rod type elements are respectively attached to respective transverse support members hingedly attached to said housing for selective folding over said stripline array.

* * * * *